United States Patent [19]

Judkins

[11] 4,127,975

[45] Dec. 5, 1978

[54] CONCEALED FASTENERS FOR WALL PANELS

[76] Inventor: Thomas Judkins, 116 W. University Pkwy., Baltimore, Md. 21210

[21] Appl. No.: 828,097

[22] Filed: Aug. 26, 1977

Related U.S. Application Data

[63] Continuation of Ser. No. 705,517, Jul. 15, 1976, abandoned.

[51] Int. Cl.[2] ..... E04B 5/52

[52] U.S. Cl. ..... 52/489

[58] Field of Search ..... 52/489, DIG. 6, 281, 52/481, 347, 350–357, 483

[56] References Cited

U.S. PATENT DOCUMENTS

| | | | |
|---|---|---|---|
| 2,281,519 | 4/1942 | Faber | 52/489 X |
| 2,410,922 | 11/1946 | Balduf | 52/481 X |
| 3,047,985 | 8/1962 | Murphy | 52/483 |
| 3,187,389 | 6/1965 | Anderson | 52/489 |
| 3,308,590 | 3/1967 | Ettore et al. | 52/281 |

FOREIGN PATENT DOCUMENTS

| | | | |
|---|---|---|---|
| 1362162 | 4/1964 | France | 52/483 |

*Primary Examiner*—Price C. Faw, Jr.
*Assistant Examiner*—Carl D. Friedman
*Attorney, Agent, or Firm*—Larson, Taylor and Hinds

[57] ABSTRACT

An improved method and means for attaching a panel of sheet rock or gypsum board to either wooden or metal studs for constructing walls and/or ceilings, etc. The studs are spaced apart from their centers the distance of the width of the panel. The panel is held to the studs by clips having one or more pointed piercing elements adapted to engage the edge of the panel with a holding portion of the clip extending outwardly from the main base portion of the clip and in the opposite direction from the pointed end of the piercing elements, having an aperture through the holding portion for securing the clips to the studs. The clips are further provided with spacer elements extending outwardly on the surface of the clip opposite the panel piercing elements for spacing the edge of the panels outwardly from the studs. This spacing of the panels from the studs will minimize the noises picked up by the panels from being transferred to the studs.

2 Claims, 6 Drawing Figures

CONCEALED FASTENERS FOR WALL PANELS

This is a continuation of application Ser. No. 705,517 filed July 15, 1976, now abandoned.

The present invention relates to building construction and in particular to a method and means for securing panels of sheet rock or gypsum board to pre-set studs.

One object of the invention is to provide improved type clips having means for engaging the edge of the panel and providing means for securing the clip to the pre-set stud.

Another object of the invention is to provide means on the clip for offsetting the clip slightly from the stud.

While several objects of the invention have been set forth, other objects, uses and advantages will become apparent as the invention is more fully described in the following description with reference to the accompanying drawings.

Figure 1:
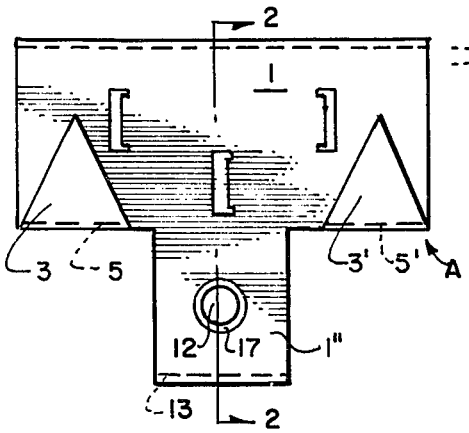
FIG. 1 is a top plan view of the improved clip.
Figure 2:
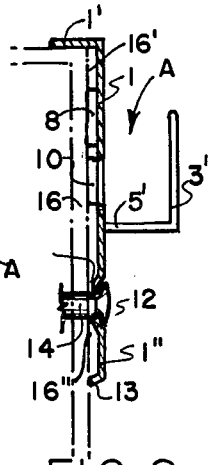
FIG. 2 is a sectional view of the clip taken on line 2—2 of FIG. 1.
Figure 3:
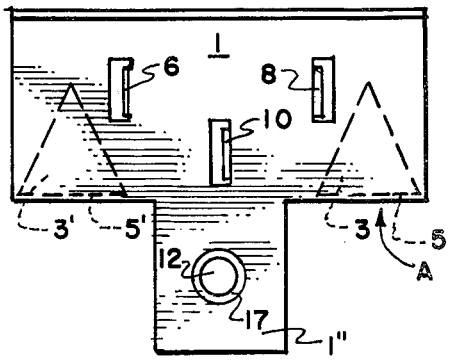
FIG. 3 is a bottom view of the clip showing means for off-setting the clip from the stud.

Referring first to the structure of the clip, wherein the clip A is preferably formed of a single stamping formed from thin but sturdy material, the clip A is provided with a main base section 1 having at least a pair of spaced, pointed arrow-like, panel engaging elements 3 and 3' preferably formed integrally with the base and spaced outwardly from one edge of the base by the portions 5. The elements 3 and 3' extend parallel with one of the side surfaces of the clip. The opposite side of the base of the clip is provided with outwardly extending spacing members 6, 8, 10 and 13 for spacing the clip is predetermined distance from the said stud.

Across one edge of the clip and at approximately right angles to the base portion 1 is a portion 1' which is advantageous in aligning the clips with the studs.

Extending from one edge of the main base portion 1 and opposite the angled portion 1' is a holding portion 1'' for holding the clip to a stud 16. Extending through this holding portion 1'' is an aperture 12 through which a screw or other fastening means may be inserted to engage the stud 16. Extending about the aperture 12 is a shoulder 17 preferably in the form of a depressed area 17 which allows for the clip securing means, such as a screw head, to be at least partly received therein and preferably flush with the outer surface of the portion 1'' and at the same time this shoulder or depressed area 17 extends beyond the opposite surface of the clip from the stud and prevents cocking of the clip when the screw 14 is in place. The outer end of the clip is shaped to form the spacer 13 and which also is an aid in keeping the base of the clip parallel with the face of the stud when the clip is secured to the stud. When installing a wall panel, the studs are set at the exact distance between their centers as the width of the panel, as shown in FIG. 4.

Figure 6:
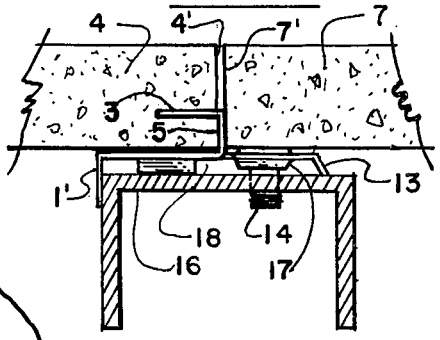
FIG. 6 is an enlarged sectional view taken on line 6—6 of FIG. 4 showing the offset of the panel from the stud.
Figure 4:
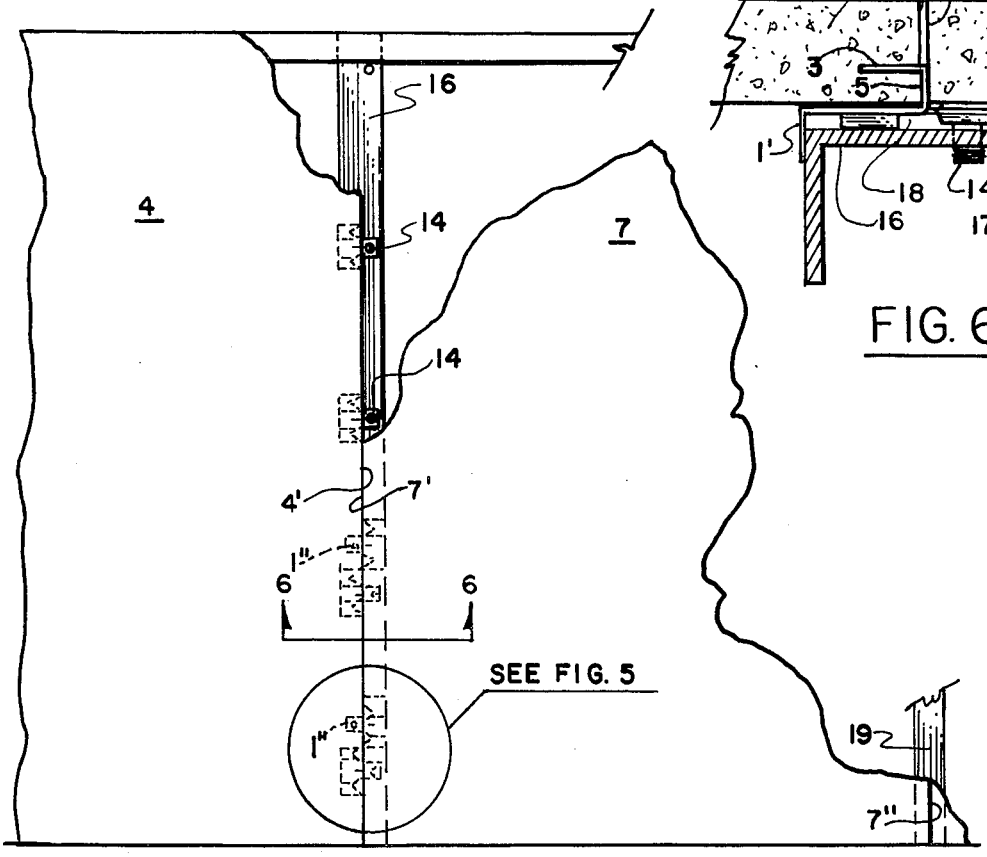
FIG. 4 is a fragmentary elevational view of a wall section showing the manner in which the clips are used to secure the sheet rock panel to the studs.
Figure 5:
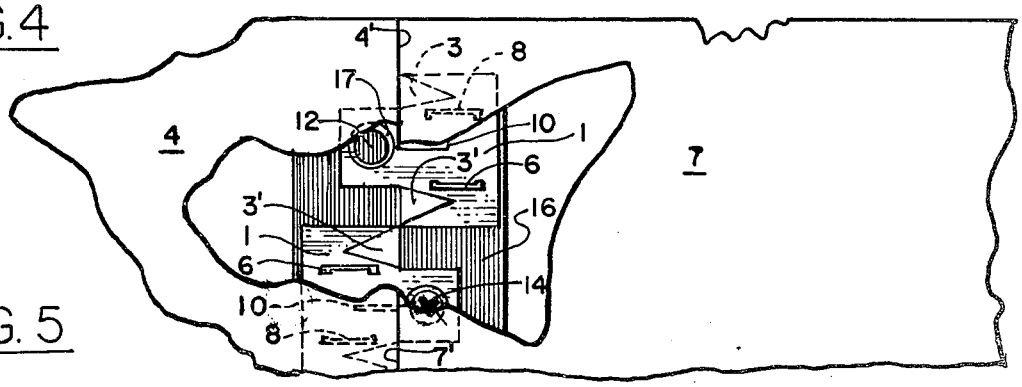
FIG. 5 is an enlarged fragmentary view in elevation showing the precise manner in which the clips engage the edge of the sheet rock panel and how they are secured to the studs along one edge of the panel and held between the sheet rock panel and stud for attaching one edge of a subsequent panel.

The pointed elements 3 and 3' of the clip 1 are inserted into the edge 4' of a panel 4, as shown in FIG. 4. The panel is then placed in position against the studs 16 and the clips are secured to the studs by the screw 15 which are spaced from the stud by the length of the offset member 6, 8, 10 and 13. The spacing 18 is of such width as to receive the end portion 1'' of the clip carried by the edge of the adjacent panel which clips are not secured to the stud but are held in place by the first-mentioned panel. The best length of the offset members has been found to be approximately ⅛ to 1/16 inch. Preferably five or six clips are placed along an 8-foot length of the panel. After the first panel 4 has been secured to the stud 16 the second panel 7 is prepared for attaching to the studs which is done in the following manner, and is substantially the same method as described for panel 4, namely, the pointed elements 3 and 3' of the clips and inserted along each lateral edge of the panel 7. The clips extending along the edge 7' of the panel are not fastened to the stud 16 by the screws 14 and are placed so as to not coincide with the clips in the first panel 4 fixed to the stud, but to one side and preferably adjacent thereto. The clips are inserted on the edges 7' and 7'' of the panel 7 and the holding portion 1'' of the clip is inserted into the space 18 between the panel 4 and the stud 16. The space 18 results from the spacer members 6, 8, 10 and 13 carried on the clip as previously described and are best shown in FIG. 6. The same number of clips is preferably used on subsequent panels as described for use on the first-mentioned panel 4.

The opposite edge 7'' of the panel 7 is fixed to a companion stud 19 by screws or other securing means as described for panel 4. The remaining panels are attached to the subsequent studs in the same manner as previously described for panels 4 and 7.

This method of positioning and holding one edge of a subsequently installed panel by the previously installed panel reduces the labor costs of installing this type wall in which only one half the number of clips are now used in the installation of the wall.

The present type clip does not require any slotting of the studs or bridging of the studs or any other configurations to hold the clips in place as is now necessary with most of the present type clips. The hole for the screw or other securing means is not made in the stud until the wall panel is in its proper place, which provides for better construction and therefore a sturdier wall. This type construction in which the panel is spaced outwardly from the stud by the spacer elements carried by the clip also reduces the transmission of sounds through the wall.

While a particular form of the invention is described, it is not intended as a limitation as the scope of the invention is best defined in the appended claims.

I claim:

1. A modular wall construction comprising in combination, at least first and second parallel mounted panel boards, an associated wall supporting stud extending along the line of jointure between the panel boards and a plurality of fasteners for mounting each of said panel boards to said wall support stud, each said fastener comprising a continuous main base portion having a width equal to the width of the fastener, an extension portion extending outwardly from a central portion of the base portion in substantially the same plane therewith, said extension portion having an aperture therethrough adapted to attach the fastener to a said stud and including an end part which extends outwardly therefrom and which is bent away from the plane thereof so as to assist in guiding the fastener into place, at least one vertical wall section extending upwardly from said base portion and including at least one pointed panel engaging element located in a place parallel to and spaced from the said base portion, at least one integrally formed spacer element formed at least partially in the base portion of the fastener at a central location therein and extending outwardly from the plane of the base portion on the opposite side of the base portion from the pointed panel engaging element and being of such a depth as to provide a space between the panel board and the stud, said plurality of fasteners comprising at least two said fasteners each of which is secured to said first panel board by the said pointed panel engaging element thereof and is attached to said stud by securing means extending through the aperture in said extension portion of said main base portion and at least one further said fastener secured to the second panel board by the pointed panel engaging element thereof with the extension portion of the main base portion thereof being unconnected to said stud and being received in the space between the first panel board and the stud, provided by the spacer elements of said two fasteners secured to said first panel board, so as to constitute the tongue of a tongue and groove arrngement.

2. A modular wall construction as claimed in claim 1 wherein said end part comprises a spacer portion of substantially the same depth as said at least one spacer element.

* * * * *